US005704412A

United States Patent [19]

Gurdebeke

[11] Patent Number: 5,704,412

[45] Date of Patent: Jan. 6, 1998

[54] SELF-ALIGNING SAND MOLD INSERT ASSEMBLY

[75] Inventor: Robert G. Gurdebeke, Windsor, Canada

[73] Assignee: Ford Global Technologies, Inc., Dearborn, Mich.

[21] Appl. No.: 597,064

[22] Filed: Feb. 5, 1996

[51] Int. Cl.[6] ..... B22D 15/04

[52] U.S. Cl. ..... 164/127; 164/354; 164/355

[58] Field of Search ..... 164/127, 137, 164/339, 352, 353, 354, 355, 357, 371

[56] References Cited

U.S. PATENT DOCUMENTS

| | | |
|---|---|---|
| 843,679 | 2/1907 | Johns . |
| 1,093,443 | 4/1914 | Lester . |
| 2,420,003 | 5/1947 | Miller . |
| 2,431,879 | 12/1947 | Mebs . |
| 3,045,301 | 7/1962 | Webbere . |
| 3,076,240 | 2/1963 | Schlein . |
| 3,370,643 | 2/1968 | Lorenz . |

FOREIGN PATENT DOCUMENTS

| | | |
|---|---|---|
| 3-140413 | 10/1989 | Japan . |

*Primary Examiner*—Kuang Y. Lin
*Attorney, Agent, or Firm*—Joseph W. Malleck

[57] ABSTRACT

A retractable metal insert assembly for a core sand mold having at least one sand core element provided with walls to define an opening communicating with a molding cavity, the walls presenting a stepped neck which is dimensionally accurate within ±0.002 inches, the mold further including a metal support associated with the core element. The insert assembly comprises: (a) a metal guide detachably secured to the metal support; (b) a metal chill element extendible through the opening to present a metal molding surface which insert has walls mateable with the stepped neck for accurate alignment; and (c) biasing means acting between the guide and insert to urge the mating walls together for self positioning of the insert. The insert assembly can be repeatedly reused in a method of making castings.

16 Claims, 2 Drawing Sheets

SELF-ALIGNING SAND MOLD INSERT ASSEMBLY

TECHNICAL FIELD

This invention relates to the art of making metal articles from sand molds, and more particularly to selectively varying the microstructural dendritic arm spacing of the cast metal article at certain locations.

DISCUSSION OF THE PRIOR ART

Metal castings, for automotive engine components, such as aluminum cylinder heads, have critical areas that require enhanced mechanical properties to avoid cracking during repeated thermal cycling in service. Cylinder heads are desirably cast with sand molds because of the faster manufacturing cycle time achieved, resulting in higher productivity. However, an all sand core mold induces a relatively slow solidification rate for the molten metal because heat transfer through the sand is retarded by the insulating effect of the sand itself. The solidification rate of the molten metal significantly influences the mechanical properties of the cast metal; the faster the rate, the shorter the microstructural dendritic arm spacing (DAS) and correspondingly the higher the tensile and fatigue strength.

How to retain the productivity benefits of sand molding and yet economically achieve selectively improved microstructural DAS in certain locations, with ease of installation, has remained a problem. Thinner cast sections will inherently cool more rapidly, but in castings that have need for improved properties in only certain areas of the casting, section thickness may not coincide with the need to induce more rapid cooling. Some other means must be provided.

Metal chills have been used historically to selectively increase cooling rates in sand or plaster molds but have limited to ferrous castings and to simple shapes or surfaces. The use of such metal chills have been not been self locating and depend upon precise planting, which is not easy to achieve in high production systems (see for example U.S. Pat. No. 3,076,240).

SUMMARY OF THE INVENTION

It is an object of this invention to provide a self locating metal chill insert assembly for sand mold packages that is easy to install and is retractable for reuse and repeat molding operations.

It is also an object of this invention to provide a method of more economically and reliably casting complex light metals, such as aluminum cylinder heads, with selective zones of reduced DAS of less than 30 microns.

A retractable metal insert assembly for a core sand mold that meets the object above, comprises in one aspect the following structure. The metal insert assembly is for use with a mold having at least one sand core element provided with walls to define an opening communicating with a molding cavity, the walls present a stepped neck which is dimensionally accurate within ±0.002 inches, the mold further including a metal support associated with the core element. The insert assembly comprises: (a) a metal guide detachably secured to the metal support; (b) a metal chill element extendible through the opening to present a metal molding surface which insert has walls mateable with the stepped neck for accurate alignment; and (c) biasing means acting between the guide and insert to urge the mating walls together for self positioning of the insert.

Another aspect of this invention is a method of making light metal castings, which comprises (a) forming a core sand mold with a casting cavity, the mold having at least one sand core element provided with walls to define an opening communicating with the molding cavity, the walls presenting a stepped neck which is dimensionally accurate within ±0.002 inches, the mold further including a metal support associated therewith; (b) forming and installing a retractable metal insert assembly, the assembly comprising (i) a metal guide detachably secured to the metal mold support, and (ii) a metal chill element extendible through the opening to present metal molding surfaces and having walls mateable with the stepped neck for accurate alignment, (iii) a spring bias acting between the guide and insert to urge the mating walls together for self positioning of the chill element, and (iv) stop means for retaining the assembly unitary at all times; (c) pouring molten light metal into the cavity, with the insert assembly accelerating the cooling of the metal in the cavity to decrease the DAS of the solidification in zones adjacent to the metal insert assembly; and (d) after allowing for the metal to solidify throughout the casting, retracting said insert assembly by releasing the guide from the support and withdrawing the insert assembly, said stop means retaining said insert assembly in a unitary fashion for reuse.

DETAILED DESCRIPTION AND BEST MOLD

Figure 1:
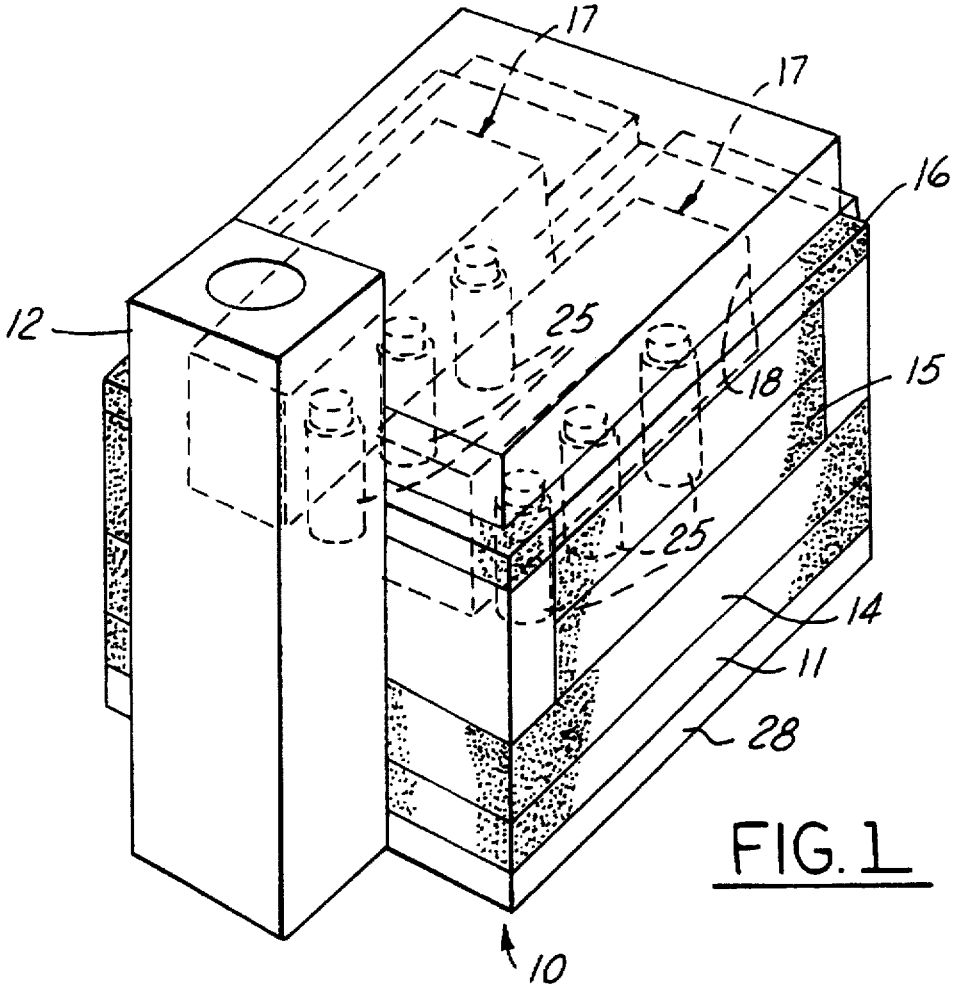
FIG. 1 is an illustration of a core sand mold showing location of retractable metal mold insert assemblies.
Figure 1A:
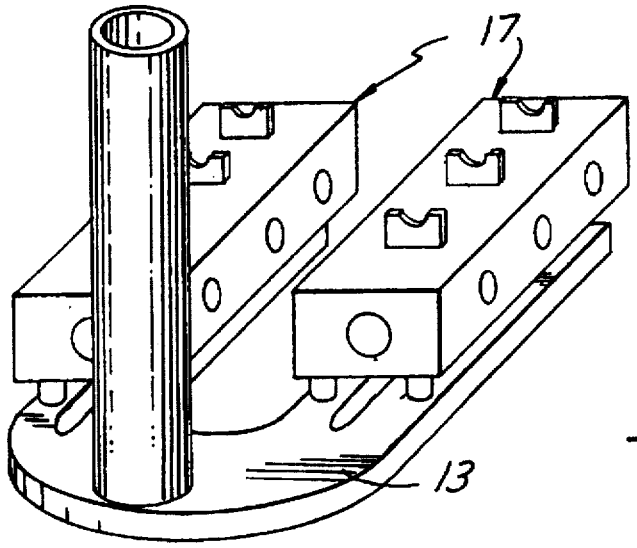
FIG. 1A depicts the gating system that feeds the casting cavities of FIG. 1 (all sand of the molding package has been removed)

As shown in FIG. 1, a core sand mold package 10, such as for casting an aluminum cylinder head useful in an internal combustion engine, has several parts. The package comprises several layered sand core elements which are layered one upon another. The multiple sand cores are necessary because of the complexity of the internal cavity that shapes a cylinder head. A support sand core 11 extends beneath the entire package 10 including the base of a sprue 12 and a molten metal feeding system 13 (see FIG. 1A), both of which reside below the bottom surface of the cylinder head cavity to allow for bottom filling of the mold cavity. A base sand core 14 is placed upon the support core 11 and is useful in defining the bottom surface of the cylinder head including the combustion chambers; a middle sand core 15 is placed on the base core 14 and is useful in defining intake and exhaust passages leading from the several combustion chambers. A top core 16 is placed on the middle core 15 to define valve train and camshaft galleries as well as the top surface of the cylinder head. Such a composite of sand cores collectively define an internal cavity 17 presenting a complex molding surface 18.

Figure 2:
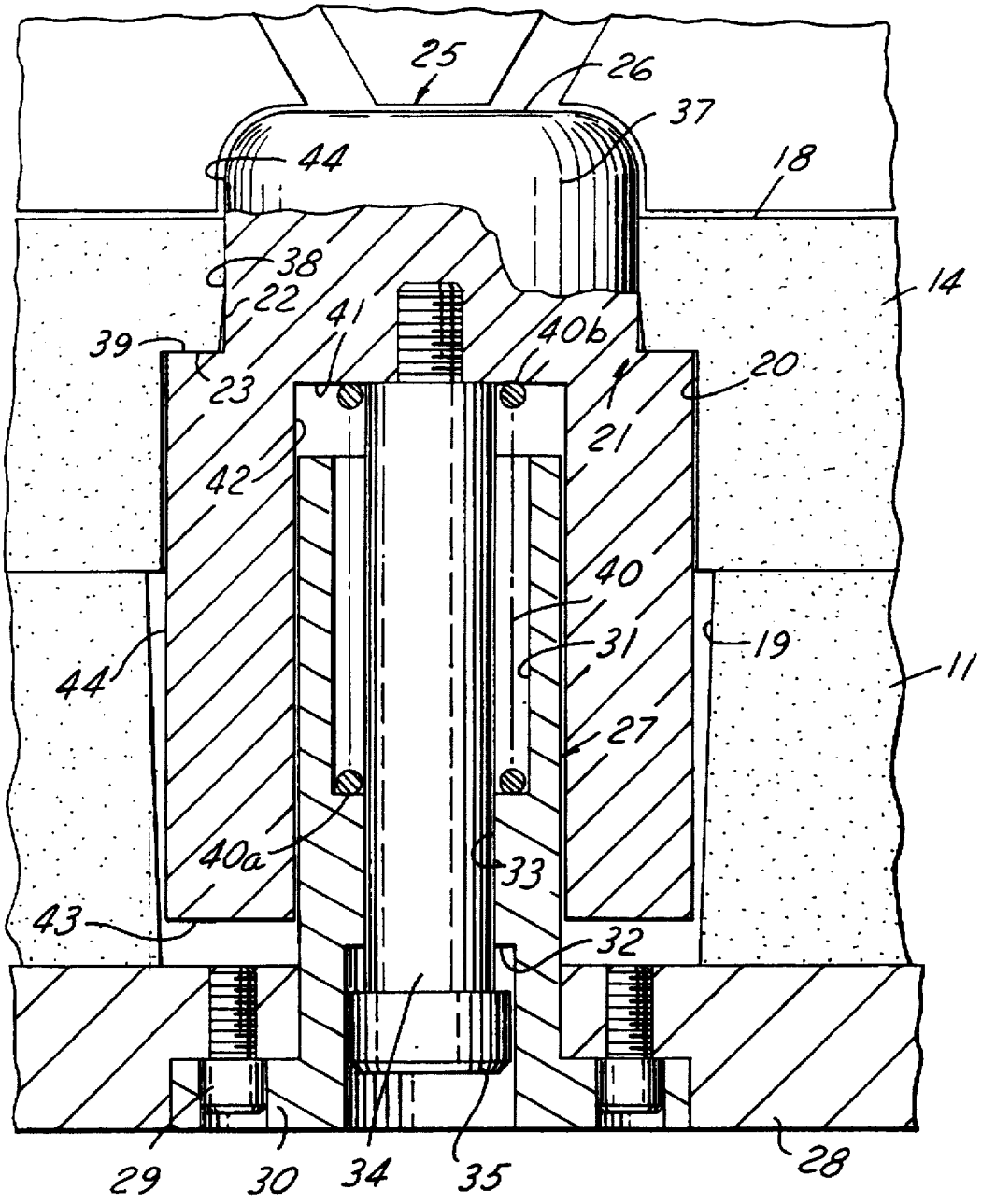
FIG. 2 is a highly enlarged sectional view of one of the retractable metal mold insert assemblies located in FIG. 1.

Turning now to FIG. 2 which focuses on a single insert assembly, the support sand core 11 and the base sand core 14 has walls 19 and 20 respectively which define aligned circular cylindrical openings that extend through such cores to reach surface 18 of the base core and thereby communicate with the complex cast cavity 17. The wall 20 also has a stepped neck 21 formed thereon adjacent to surface 18; the stepped neck comprises walls 22 and 23 which are mutually perpendicular to each other and are located accurately within a dimension of ±0.002 inches. Retractable metal insert assemblies 25 fit into the aligned circular cylindrical openings to define a curved linear combustion chamber molding surface 26. The metal insert assembly comprises a metal guide 27 which is releasably secured to a core package metal presentation plate 28 by threaded fasteners 29 that couple a radially extending flange 30 of the guide to the plate 28. The guide is formed as a sleeve with a smooth cylindrical interior 31 which is stepped at 32 to define a guide surface 33 for cradling a retention pin 34 secured to the remainder of the assembly. The pin has an enlarged head 35 limiting sliding movement of the pin relative to the guide 27 in one direction.

A metal chill element 37 is resiliently carried on the guide 27; the element 37 has a hollow interior 42 at one end 43, the hollow interior extending over the guide 27. The exterior of the element 37 extends through the walls 19 and 20 to present the metal mold surface 26 that rises above the surface 18 of the base core. The chill element has stepped walls 38, 39 mateable respectively with the base core walls 22, 23 so that when in mating contact, the clearance therebetween is equal to or less than 0.004 inches at each pair of mating surfaces thereby to obtain a highly accurate positioning and alignment. The chill element 37 is resiliently biased to achieve such mating relationship by a coiled compression spring 40 that operates with one end **40*a* engaging step 52 and an opposite end 40*b* engaging a flat end wall 41 of the hollow interior 42 of the chill element. Such spring resiliently urges the element 37 away from the fixed guide 27, promoting a mating relationship between surfaces 22 and 38, 23 and 39. The wall 20 of base core 14 and wall 19 of support core 11 are sized to provide a significant spacing with respect to the outer diameter of the chill element 37 thereby allowing for thermal expansion of the metal chill element with respect to the sand cores. Such spacing may be about 0.04 inches or greater. With adequate mass in the chill element 37, selective rapid solidification of molten metal adjacent the surface 26 will take place resulting in reduced dendritic arm spacing of the solidified microstructure, comparable to that obtained with an all metal mold, such as DAS of 30 microns. Such selective rapid solidification is obtained with accurate self-location of the assembly as a result of insertion. The retractable metal insert assemblies are capable of rapid reusability when making light metal castings such as aluminum cylinder heads having complex ported cavities which demand differing microstructures at different locations of the casting. To this end, the method of this invention first requires formation of a core sand mold 10 with a cavity 17, a least one of the core elements 14 of the sand mold 10 being provided with walls 20 to define an opening communicating with the mold cavity 17, the walls presenting a stepped neck 21 which is dimensionally accurate within ±0.002 inches. Next there is formed and installed a retractable metal insert assembly 25 having a chill element 37 which is extendible through the opening to present a metal molding surface 26. The insert assembly has walls 38, 39 which are mateable with the stepped neck 21 for accurate self-alignment when biased thereagainst. Such mateable surfaces are biased together by resilient means 40 that operates between a fixed guide 27 and the chill element 37**.

Next, molten metal of a light metal (such as aluminum, titanium or magnesium) is poured into the molding cavity 17 such as through a bottom gating or feeding system 13 from a gravity pouring sprue 12. The insert assembly accelerates the cooling of the molten metal in contact with the insert surface 26 thereby decreasing the dendritic arm spacing of the solidified metal that is so influenced.

After allowing for the poured metal to solidify throughout the entire casting cavity 17, the insert assemblies 25 are retracted and withdrawn from the sand molding package 10. Guides 27 of the metal insert assemblies are released from the support and withdrawn; the insert assemblies will be withdrawn with the guides by virtue of stop means 34 that prevents the chill element from totally separating from the guide. The stop means comprises a pin surface threadedly secured to the interior of the chill element (at 41) and carry a head that limits sliding movement of the pin within the guide. Thus, the insert assembly can be quickly reinstalled in another mold package and reused.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

We claim:

1. A casting mold comprising a retractable metal insert assembly, the mold having at least one sand core element provided with walls to define an opening communicating with a molding cavity, said walls presenting a stepped neck which is dimensionally accurate within ±0.002 inches, said mold including a metal support associated therewith, the assembly comprising;

(a) a metal guide detachably secured to said metal support;

(b) a metal chill element extendible through said opening to present a metal molding surface in said cavity, said chill having walls mateable with said metal guide for alignment and said metal chill element walls mateable with the stepped neck for accurate alignment; and (c) biasing means acting between said guide and said metal chill element to urge said metal chill element walls into engagement with said stepped neck of said core walls for self positioning of the chill element relative to the mold.

2. The insert assembly as in claim 1, in which said assembly further comprises stop means for limiting separating movement of said chill element from the guide when retracted from the mold assembly.

3. The metal insert assembly as in claim 1, in which said mating walls have a clearance therebetween of no greater than 0.004 inches.

4. The metal insert assembly as in claim 1, in which said stepped neck walls are mutually perpendicular to each other.

5. The metal insert assembly as in claim 1, in which said guide is a post and said insert is a sleeve slidably enveloping said post.

6. The insert assembly as in claim 5, in which said post is hollow and said biasing means comprises a coiled spring that is carried within the post and acts between a step on the interior surface of said post and the chill element.

7. The insert assembly as in claim 6, in which a pin depends from the hollow part of said chill element, said pin having a stop effective to limit relative movement of said chill element with respect to the guide.

8. The insert assembly as in claim 1, in which said support is a metal plate having a thickness of at least 1.25 inches, said metal chill element having a clearance with said one core element that is equal to or greater than 0.04 inches when at room temperature, except at said mating surfaces.

9. The insert assembly as in claim 1, in which said one core element is comprised of a base core supported on a support core, said core is being comprised of zircon sand.

10. A method of making a light metal casting, using retractable and reusable metal chill elements, comprising:

(a) forming a core sand mold with a cavity, the mold having at least core element provided with walls to define an opening communicating with the mold cavity, the walls presenting a stepped neck which is dimensionally accurate within ±0.002 inches, and has a metal support associated with the core sand mold;

(b) forming and installing a retractable metal insert assembly in said mold, said assembly comprising a metal guide detachably secured to the metal support and a metal chill element extendible through the opening of said core element to present a metal molding surface within said cavity, said chill element having walls mateable with said metal guide for alignment and said metal chill element walls mateable with the stepped neck of the mold for accurate alignment, said insert assembly further having a biasing means acting between the guide and said metal chill element to urge the metal chill element walls into engagement with said stepped neck of said core walls for self positioning and having a stop means to prevent total separation of the chill element from the guide;

(c) pouring molten light metal into the cavity while the insert assembly accelerates the cooling of said metal in contact with the insert metal surface to thereby decrease the dendritic arm spacing of the solidified metal adjacent to said insert; and (d) after allowing for said poured metal to solidify within said cavity to form a casting, retracting said insert assemblies by releasing said guide from said support and withdrawing said insert assembly, said stop means retaining said insert assembly as a unified assembly free of said mold.

11. The method as in claim 10, in which said light metal is selected from the group of aluminum, titanium and magnesium.

12. The method as in claim 10, in which said mold is comprised of zircon sand.

13. The method as in claim 10, in which said casting is a cylinder head for a internal combustion engine, and said insert assembly is positioned to effect the dendritic arm spacing in the bridges of the casting between port openings of the cylinder head.

14. The method as in claim 13, in which said dendritic arm spacing is point 30 microns.

15. The method is in claim 10, in which said step (d) takes place over a period of about 2 minutes.

16. The method as in claim 10, in which said metal poured in step (c) is H-13 steel.

* * * * *